US005735242A

United States Patent [19]

Kahlenbeck et al.

[11] Patent Number: 5,735,242

[45] Date of Patent: Apr. 7, 1998

[54] FUEL PRESSURE ACTIVATED ENGINE COMPRESSION BRAKING SYSTEM

[75] Inventors: Jim Kahlenbeck; John Jerl Purcell, both of Columbus, Ind.

[73] Assignee: Cummins Engine Company, Inc., Columbus, Ind.

[21] Appl. No.: 634,062

[22] Filed: Apr. 17, 1996

[51] Int. Cl.[6] ..... F01L 13/06; F02D 13/04; F02D 43/00

[52] U.S. Cl. ..... 123/322

[58] Field of Search ..... 123/321, 322, 123/324

[56] References Cited

U.S. PATENT DOCUMENTS

| | | | |
|---|---|---|---|
| 3,220,392 | 11/1965 | Cummins | 123/321 |
| 3,367,312 | 2/1968 | Jonsson | 123/321 |
| 4,158,348 | 6/1979 | Mason et al. | 123/321 |
| 5,000,146 | 3/1991 | Szucsanyi | 123/321 |
| 5,315,974 | 5/1994 | Sabelström et al. | 123/320 |
| 5,564,386 | 10/1996 | Korte et al. | 123/321 |

FOREIGN PATENT DOCUMENTS

| | | |
|---|---|---|
| 0747576 | 11/1996 | European Pat. Off. . |
| 2291126 | 1/1996 | United Kingdom . |
| 2304152 | 3/1997 | United Kingdom . |
| 9639573 | 12/1996 | WIPO . |

OTHER PUBLICATIONS

Compact High Performance Fuel System With Accumulator, Cavanagh et al., Doc. No.WO94/27041 Nov. 24, 1994, Drawing sheet 1 and pp. 1, 32–35.

*Primary Examiner*—Andrew M. Dolinar

*Attorney, Agent, or Firm*—Sixbey, Friedman, Leedom & Ferguson; Charles M. Leedom, Jr.; Tim L. Brackett, Jr.

[57] ABSTRACT

A compression braking system is provided which permits an engine's exhaust valves to be operated by fuel pressure during a braking mode independently of the engine's mechanical actuating elements and associated control limitations. The present braking system includes a high pressure fuel supply including a high pressure fuel accumulating device for accumulating and temporarily storing high pressure fuel and an actuator device including an actuator piston operatively connected to the engine exhaust valve and a brake actuating valve for controlling fuel flow from the accumulating device to the actuator piston. The pressure of the fuel acting on the actuator causes movement of the exhaust valve. The system may include a pressure regulator for decreasing the accumulator fuel pressure to a more appropriate actuation fuel pressure to minimize high pressure joints and leakage. A improved sealing means may be provided for preventing leakage around the actuator piston. The braking system may further include a pressure reduction device for reducing the fuel pressure acting on the actuating piston after the initial movement of the piston.

27 Claims, 4 Drawing Sheets

FUEL PRESSURE ACTIVATED ENGINE COMPRESSION BRAKING SYSTEM

TECHNICAL FIELD

This invention relates to a compression engine braking system for an internal combustion engine which uses a source of pressurized fuel for selectively activating the engine exhaust valves to operate the engine in a braking mode.

BACKGROUND OF THE INVENTION

For many internal combustion engine applications, such as for powering heavy trucks, it is desirable to operate the engine in a braking mode. This approach involves converting the engine into a compressor by cutting off the fuel flow and opening the exhaust valve for each cylinder near the end of the compression stroke.

An early technique for accomplishing the braking effect is disclosed in U.S. Pat. No. 3,220,392 to Cummins, wherein a slave hydraulic piston located over an exhaust valve opens the exhaust valve near the end of the compression stroke of an engine piston with which the exhaust valve is associated. To place the engine into braking mode, three-way solenoids are energized which cause pressurized lubricating oil to flow through a control valve, creating a hydraulic link between a master piston and the slave piston. The master piston is displaced by an engine element, such as a fuel injector actuating mechanism or rocker lever, periodically in timed relationship with the compression stroke of the engine which in turn actuates the slave piston through hydraulic force to open the exhaust valves. U.S. Pat. No. 3,367,312 to Jonsson discloses another engine braking system including a cam-actuated rocker arm having a plunger, or slave piston, positioned in a cylinder integrally formed in one end of the rocker arm wherein the plunger can be locked in an outer position by hydraulic pressure to permit braking system operation. In addition, a control valve is used to control the flow of pressurized fluid to the rocker arm cylinder so as to permit selective switching between braking operation and normal power operation.

The braking systems disclosed in both Cummins and Jonsson discussed hereinabove rely on camshaft lobes and/or push tubes for mechanically activating the exhaust valves during the braking mode. Although functional, this design restricts the timing of opening and closing the exhaust valves to the cam lobe timing and lift parameters as defined by the cam lobe profiles used for the fuel injector or other cam operated engine component. As a result, the braking systems of the types disclosed in Cummins '392 and Jonsson '312 can not be controlled to provide peak efficiency and maximum braking at all engine speeds and operating conditions.

U.S. Pat. No. 5,000,146 to Szucsanyi and U.S. Pat. No. 4,158,348 to Mason et al. both disclose a compression engine braking system including an actuating piston operable by fluid pressure to control the position of an exhaust valve for controlling engine braking. Pressurized engine fuel is used to actuate the actuating piston during the braking mode. However, the pressurized fuel is supplied by an in-line injection pump which delivers timed fuel pulses or charges directly to the injector during the engine power mode and to the exhaust valve actuator during the braking mode. As a result, the duration and timing of opening and closing of the exhaust valves during the braking mode of engine operation is disadvantageously limited to the duration and timing of the effective stroke of the in-line pump.

In addition, these in-line systems use a control valve positioned along the delivery line between the in-line pump and injector to selectively control fuel flow to the injector and actuating piston depending on the engine mode desired. The connection at the control valve creates an irregularity in the fuel flow path resulting in a pressure loss at the connection and increased hydraulic dead volume. As a result, the injection pump must be designed with an unnecessarily large pressure rating or capacity to compensate for the pressure loss and volume increase. Also, the injection fuel is delivered to the exhaust valve actuating devices at high injection pressure levels thereby increasing the likelihood of leaks in the exhaust valve actuation assembly and/or the costs associated with providing connections capable of sealing fluid under high pressure. In addition, these systems rely on a single control valve in the fuel delivery line connecting the injection pump to the injector to divert the injection fuel from the injector to the exhaust valve actuator. As a result, failure of the single control valve may prevent operation of the engine in the power mode and/or braking modes. Also, the system disclosed in Mason el al. uses a spool valve which is subject to undesirable fuel leakage between the valve member and its associated bore. Fuel leakage between the injector and exhaust valve delivery lines could cause inadvertent exhaust valve actuation.

U.S. Pat. No. 5,315,974 to Sabelstrom et al. discloses an engine capable of operating as a compressor by electronically opening an injector spill valve preventing fuel injection and simultaneously providing pressure to a spindle for moving the exhaust valve to an open position. However, this reference does not suggest any particular type of pressurized fluid nor the source of pressurized fluid.

Consequently, there is a need for an engine compression braking system capable of effectively and reliably controlling the duration and timing of opening and closing of the engine's exhaust valves to permit optimum engine braking mode operation.

SUMMARY OF THE INVENTION

It is an object of the present invention, therefore, to overcome the disadvantages of the prior art and to provide an engine compression braking system capable of reliably and effectively permitting selective operation of the engine's exhaust valves.

It is another object of the present invention to provide an engine compression braking system which permits operation of the engine's exhaust valves independent of the engine's mechanical actuating elements, i.e. camshaft, and associated control limitations.

It is yet another object of the present invention to provide an engine compression braking system which is relatively simple in operation and compact in size in comparison to conventional systems.

It is a further object of the present invention to provide an engine compression braking system which minimizes the height of the engine.

It is a still further object of the present invention to provide an engine compression braking system which permits the exhaust valves to be controlled during the braking mode according to an optimized engine braking performance curve.

Still another object of the present invention is to provide an engine compression braking system which uses fuel from an accumulated volume of engine fuel to operate the exhaust valves during the braking mode while regulating the pressure of the fuel.

Yet another object of the present invention is to provide an engine compression braking system using engine fuel to operate the exhaust valves which minimizes the likelihood of leaks, and the number of high pressure seals, in the braking fuel lines.

A still further object of the present invention is to provide an engine compression braking system which minimizes the pressure losses and dead volume in the fuel injection circuit.

Another object of the present invention is to provide an engine compression braking system which is capable of operating the engine in a braking mode at any and all engine crankshaft/camshaft positions to provide peak efficiency and maximum braking at all engine speeds and parameters.

These and other object are achieved by providing a compression braking system for an engine having at least one piston reciprocally mounted within a cylinder for cyclical successive compression and expansion strokes and at least one exhaust valve operable to open against a closing bias to exhaust gas from the cylinder in variable timed relationship to the piston strokes to operate the engine in either a power mode or a braking mode, comprising a high pressure fuel supply for supplying fuel at high pressure for delivery to the engine including a pump for pressurizing fuel and a high pressure fuel accumulating device for accumulating and temporarily storing fuel received from the pump at a predetermined high pressure level. The braking system also includes an actuating device for opening the exhaust valve during the braking mode which includes a brake actuating valve positioned along the braking fuel circuit for controlling fuel flow through a braking fuel circuit communicating with the accumulating device. Fuel flowing through the circuit from the accumulating device at a predetermined actuating fuel pressure causes movement of the exhaust valve. The actuating device may include an actuating chamber positioned in fluidic communication with the braking fuel circuit and an actuating piston operatively connected to the exhaust valve and positioned in the chamber for movement by fuel pressure forces. The accumulating device supplies fuel to a plurality of fuel injectors and the system may further include a pressure regulating device positioned downstream of the pump for maintaining the fuel delivered to the actuating device at a predetermined actuation fluid pressure level which is less than the predetermined high injection pressure level in the accumulating device. The pressure regulating means may be positioned along the braking fluid circuit downstream of the accumulating device or along an injection fuel circuit between the pump and accumulating device. The system may also include a rocker lever for actuating the exhaust valve which includes a power mode force receiving end and an exhaust valve actuating end. The actuating device may impart an actuating force on the exhaust valve actuating end of the rocker lever or the power mode force receiving end to move the exhaust valve. A valve crosshead may also be provided for connecting the rocker lever to the exhaust valve wherein the actuating device imparts an actuating force on the valve crosshead. The exhaust valve may be a dedicated exhaust valve which is opened only during the braking mode.

The actuating device may include an actuator housing within which the actuating chamber is formed and the actuating piston is preferably slidably mounted in the actuating chamber so as to translate within the chamber and divide the actuating chamber into a high pressure portion positioned adjacent a first end of the actuating piston and a low pressure portion positioned adjacent a second opposite end of the actuating piston. A sealing means may be provided for preventing leakage of fuel from the high pressure portion of the actuating chamber to the low pressure portion. The sealing means may include an annular low pressure seal positioned adjacent the actuating piston. The sealing means may further include a drain passage formed in the actuator housing in communication with the actuating chamber between the high pressure portion and the low pressure portion of the actuating chamber for leaking fuel from the high pressure portion to a drain. The sealing device may further include a annular recess formed in the actuating piston in communication with the drain passage. Also, the low pressure portion of the actuating chamber is maintained at a first pressure level and the drain passage is maintained at a drain passage pressure level less then the first pressure level.

The braking system may further include a pressure reduction device for reducing the fuel pressure acting on the actuating piston during movement of the piston. The pressure reduction device may include a passage formed in the actuator housing in communication with the actuating chamber and a pressure reduction valve positioned in the passage. The pressure reduction valve may include a check valve biased to block the flow of fuel from the actuating chamber.

DETAILED DESCRIPTION OF THE PRESENT INVENTION

Figure 1:
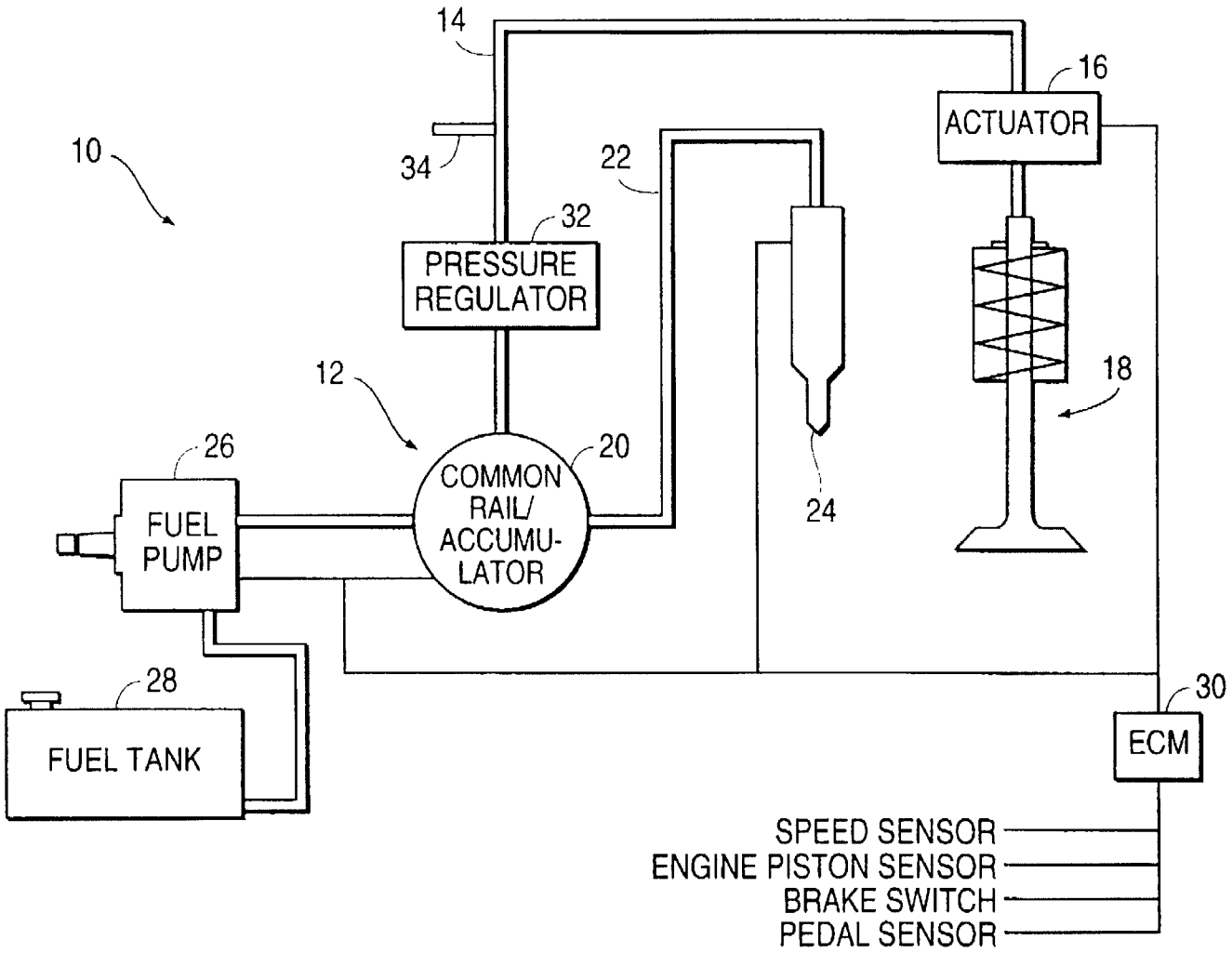
FIG. 1 is a diagrammatic illustration of a fuel pressure activated engine compression braking system for an internal combustion engine in accordance with the present invention.

As shown in FIG. 1, the novel engine compression braking system of the present invention, indicated at 10, generally includes an accumulated supply of high pressure fuel 12, a braking fuel circuit 14, an actuator assembly 16 positioned along the braking fuel circuit and an exhaust valve assembly 18 operatively connected to actuator assembly 16. Actuator assembly 16 is operated to utilize the high pressure of the fuel in the accumulated source 12 to selectively control the opening and closing of exhaust valve 18 depending on engine operating conditions to permit operating the engine cylinder (not shown) associated with the exhaust valve 18 in a braking mode.

The accumulated source of high pressure fuel 12 may be in the form of a common rail type accumulator used in common rail type fuel injection systems as shown in FIG. 1. Common rail type accumulator 20 is typically a single supply passage or rail which supplies fuel through an injection fuel circuit 22 to a respective injector 24. Any other injectors of a multicylinder combustion engine would be connected to common rail type accumulator 20 via separate branch fuel circuits such as disclosed in U.S. Pat. No.

5,133,645. Each fuel injector 24 is designed to control the timing and metering of injection by, for example, the use of a solenoid control valve mounted at each injector. Alternatively, the present braking system may be used on an engine having an accumulator-pump type fuel injection system which includes a distributing device, i.e., a rotary distributor downstream of a high pressure accumulator for distributing fuel pulses to each injector via separate delivery lines, and a timing and metering device positioned along the fuel circuit between the accumulator and distributing device for determining the timing and metering of injection. One such system is disclosed in PCT Patent Publication WO 94/27041, entitled *Compact High Performance Fuel System with Accumulator.* In both the common rail and the accumulator pump type fuel injection systems, the accumulator device 20 functions to temporarily store fuel at a high pressure for subsequent injection into the internal combustion engine. The common rail or accumulator is sized to contain a predetermined relatively large quantity of fuel to allow a controlled quantity of fuel to be delivered to each cylinder of the engine at appropriate times throughout the entire operating range of the engine. Typically, the rail or accumulator is sized in conjunction with a fuel pump 26 such that the maximum fuel pressure drop during an injection event associated with a single cylinder does not exceed a predetermined percentage of the desired injection pressure so as to maintain the stored fuel at approximately the desired injection pressure level. Fuel pump 26 draws, or is supplied, fuel from a fuel tank 28 via an auxiliary fuel supply pump at relatively low pressure and controllably delivers fuel to the accumulator 20 as necessary to maintain the desired high pressure level in the accumulator. An electronic control module (ECM) 30 controls the operation of the fuel pump in a conventional manner based on engine operating conditions and the existing accumulator pressure so as to maintain the accumulator fuel pressure at the desired predetermined level.

As shown in FIG. 1, braking fuel circuit 14 connects to an accumulator 20 at one end and to actuator assembly 16 at the other end to thereby deliver high pressure fuel to the actuator assembly 16 for operating exhaust valve 18. In the embodiment of FIG. 1, a pressure regulator 32 is positioned along braking fuel circuit 14 between accumulator 20 and actuator 16. Pressure regulator 32 functions to adjust, i.e. reduce, the pressure of the fuel flowing from accumulator 20 to minimize the tendency for leakage at various joints and connections along braking fuel circuit 14 and internal to actuator 16 while creating adequate actuating force in actuator 16, as explained hereinbelow. Pressure regulator 32 may be any conventional regulator capable of effectively reducing the fuel pressure to the desired level. For example, many common rail type accumulators and accumulators for other types of fuel injection systems store injection fuel at pressures ranging from 5000 to 30,000 psi or higher. Pressure regulator 32 allows this very high pressure level to be reduced to a level that reduces leakage but maintains a quick valve response time. This regulated braking fuel pressure level is capable of creating, in combination with actuator 16, highly effective actuating forces for opening exhaust valve 18 with a very quick valve response time. The particular pressure level to which pressure regulator 32 can be set may of course depend on various design factors such as the specific actuator design, pressure losses along braking fuel circuit 14, specific brake valve design and any forces resisting the opening movement of exhaust valve 18. Although only a single braking fuel circuit 14, actuator 16 and exhaust valve 18 is illustrated in FIG. 1, other braking fuel circuits for respective exhaust valve assemblies would be connected to the system of FIG. 1 downstream of pressure regulator 32 such as shown by branch passage 34. In this manner, pressure regulator 32 serves to regulate the pressure in all braking fuel circuits associated with each cylinder of a multi-cylinder engine. Also, the engine may include an exhaust brake valve which is separate from the engine's power mode intake and exhaust valves, and dedicated to engine braking. This dedicated brake valve arrangement is particularly advantageous in that the valve can be designed smaller than the standard exhaust valves to reduce the force, i.e. fuel pressure, necessary to operate the valve against the high pressure in the engine cylinder.

Figure 2:
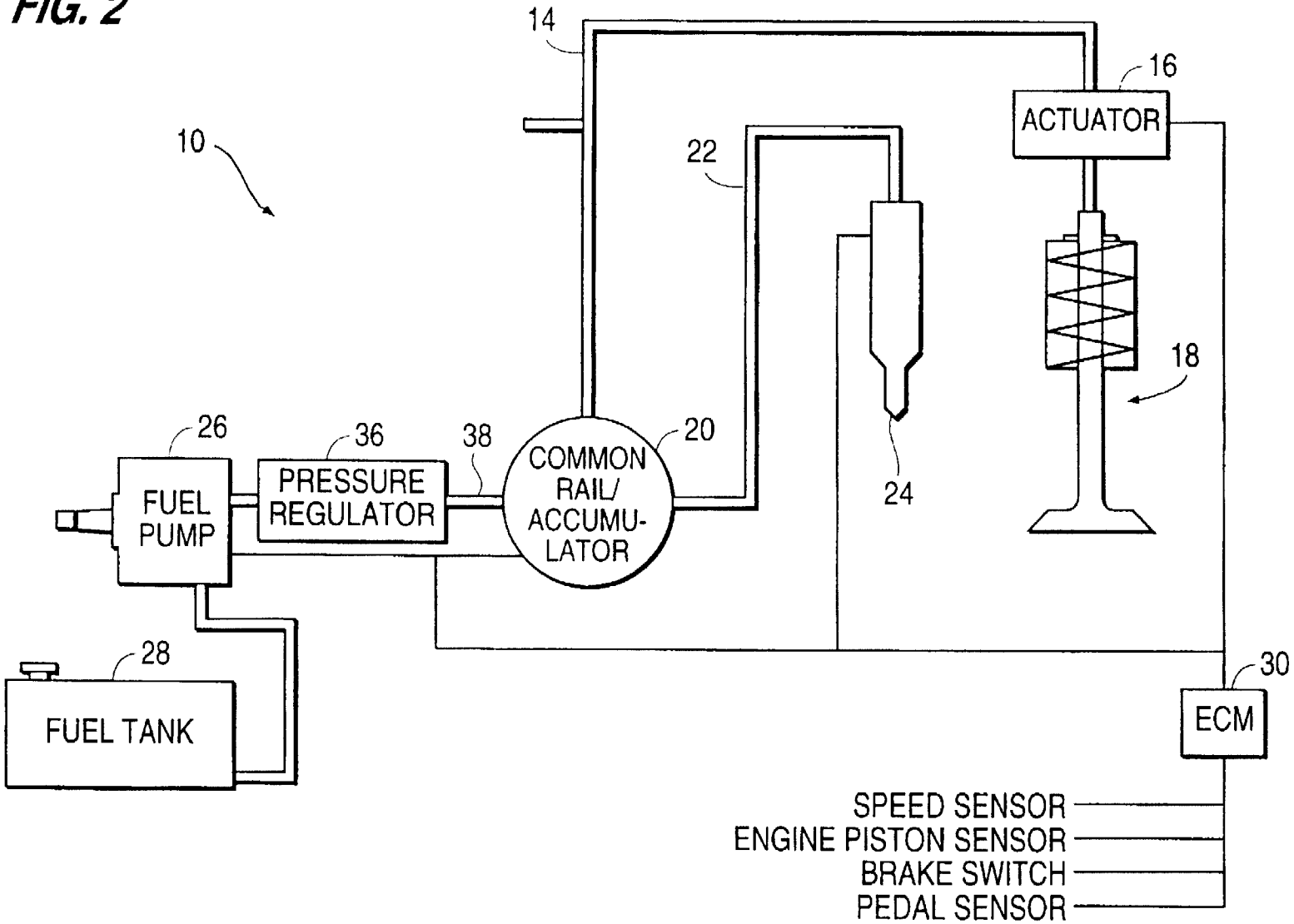
FIG. 2 is a diagrammatic illustration of an alternative embodiment of the fuel pressure activated engine compression braking system of the present invention.

Now referring to FIG. 2, a second embodiment of the present fuel pressure actuator and compression braking system is illustrated which is the same as the system shown in FIG. 1 except that a pressure regulator 36 is positioned along an injection fuel circuit 38 upstream of accumulator 20 in lieu of pressure regulator 32 of the previous embodiment. Pressure regulator 36 is typically the regulating device conventionally provided with high pressure fuel pump 26. Pressure regulator 36 must be capable of quickly controlling the output from high pressure fuel pump 26 so as to decrease the fuel pressure in accumulator 22 to the predetermined level desired for use in actuating exhaust valve 18. Therefore, upon receipt of a braking mode signal, ECM 30 will control the pressure regulator 36 in the appropriate manner to adjust, i.e. reduce, the fuel pressure in accumulator 20, and, therefore, braking fuel circuit 14 to the desired braking fuel pressure level. The adjusted pressure level in accumulator 20 does not adversely effect fuel injection since fuel injection is terminated as the engine is placed in the braking mode.

Figure 3:
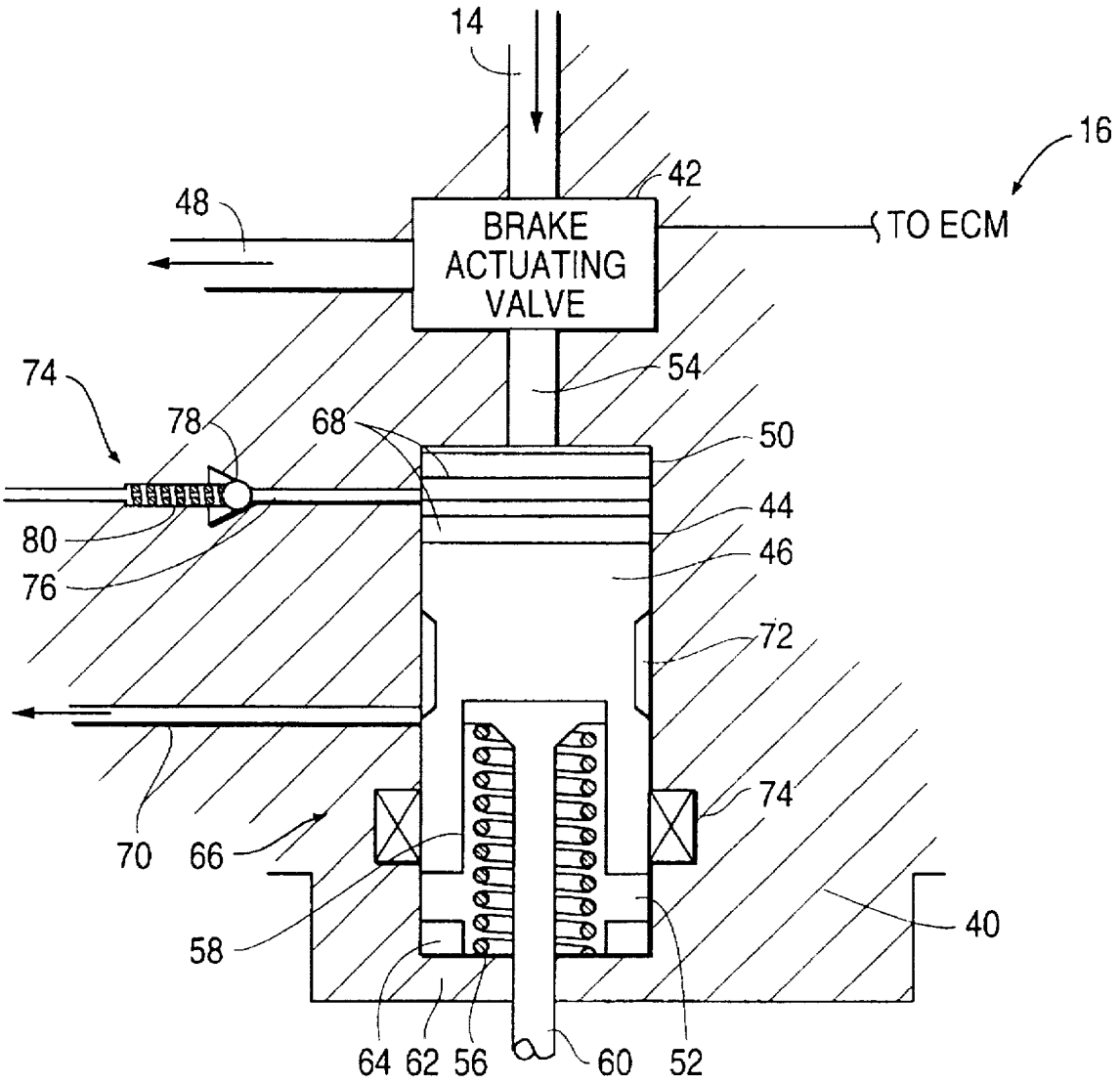
FIG. 3 is a partial cross sectional view of the actuator of the present braking system in the unpressurized, retracted position.

As shown in FIG. 3, actuator 16 includes an actuator housing 40 on which is mounted a brake actuating valve 42. Alternatively, brake actuating valve 42 may be positioned separately from actuator housing 40 upstream along braking fuel circuit 14. Actuator housing 40 also includes an actuating chamber 44 positioned downstream of brake actuating valve 42 and an actuating piston 46 slidably or translationally mounted in actuating chamber 44. Brake actuating valve 42 may be a three-way, two-position solenoid operated valve capable of moving between a de-actuated position in which fuel flow from accumulator 20 through braking fuel circuit 14 is blocked while actuating chamber 44 is connected to a relief passage 48, and an actuated position in which relief passage 48 is blocked and flow is permitted from accumulator 20 through braking fuel circuit 14 into actuating chamber 44. In this manner, brake actuating valve 42 can be controlled via ECM 30 to operate the engine valves or separate brake valves to place the engine into a braking mode.

Actuator 16 is shown in FIG. 3 in a depressurized state with actuating piston 46 in the deactuated, retracted, upper position. Actuation piston 46 divides actuating chamber 44 into a high pressure portion 50 and a low pressure portion 52. A connector passage 54 communicates with the high pressure outlet of brake actuator valve 42 at one end and opens into high pressure portion 50 at an opposite end. A return spring 56 positioned in low pressure portion 52 biases actuating piston 46 into the retracted position. Actuating piston 46 includes a central recess 58 for receiving a plunger 60 which abuts piston 46 at one end and extends through actuator housing 40 to connect to exhaust valve 18 at an opposite end. Actuator housing 40 includes a lower support 62 upon which an annular piston stop 64 is positioned. Upon movement of brake actuating valve 42 to the open actuated position, high pressure fuel entering high pressure portion 50 of actuating chamber 44 causes actuating piston 46 to move downwardly as shown in FIG. 3 into an extended position in abutment with piston stop 64 while compressing return spring 56. In this manner, plunger 60 is also extended so as to move exhaust valve 18 into an open position at the desired moment during the movement of the engine piston (not shown).

The present invention also includes a sealing arrangement 66 for preventing fuel leakage from high pressure portion 50 of actuating chamber 44 into low pressure portion 52 via the clearance gap between the outer surface of actuating piston 46 and the inner surface of actuator housing 40 forming actuator chamber 44. Since low pressure portion 52 is in communication with the valve cover environment containing engine lubricating oil for lubricating the exhaust valve assembly 16, any fuel leaking into low pressure portion 52 would mix with the engine lubricating oil impairing the lubrication qualities of the oil and ultimately increasing engine wear and/or requiring increased oil replacement. Sealing arrangement 66 of the present invention includes a pair of annular high pressure seals or seal rings 68 positioned in respective grooves formed in the outer surface of actuating piston 46 adjacent high pressure portion 50 of actuating chamber 44. High pressure seals 68 may be either split or whole rings and constructed from either metallic or non-metallic materials depending on the performance desired. High pressure seals 68 create at least a partial fluid seal between the outer surface of the high pressure seals rings 68 and the inner surface of actuator housing 40 forming actuator chamber 44. Alternatively, a high pressure seal can be maintained without high pressure sealing rings via an extremely close tolerance fit between piston 46 and housing 40, i.e. less than 10 microns diametrically. High pressure seal rings 68 or the close tolerance fit prevent a substantial amount of leakage through the clearance between actuating piston 46 and actuating chamber 44. However, since leakage will inevitably occur due to the necessary clearances, sealing arrangement 66 of the present invention also includes a drain passage 70 formed in actuator housing 40 and communicating with actuating chamber 44 at one end and a low pressure drain, such as a fuel supply inlet or the fuel tank, at an opposite end. In addition, an annular recess 72 formed in the outer surface of actuating piston 46 functions to accumulate fuel leaking from the sliding clearances and direct the fuel into drain passage 70. Annular recess 72 is positioned axially along actuating piston 46 so as to communicate with drain passage 70 in all positions of actuating piston 46. In this manner, any fuel leaking through the sliding clearances is directed to the low pressure drain via drain passage 70.

Sealing arrangement 66 also includes an annular low pressure seal ring 74 mounted on actuator housing 40 around the low pressure end of actuating piston 46. Seal ring 74 is positioned along actuating chamber 44 so that actuating piston 46 overlaps seal ring 74 throughout its movement between the retracted and extended positions. Drain passage 70 and low pressure seal ring 74 function together to create a pressure drop across the clearance space at seal ring 74 such that the pressure in drain passage 70 is maintained at a lower pressure than the pressure in low pressure portion 52 and the valve cover environment. Thus, high pressure fuel leaking from high pressure portion 50 and accumulating in annular recess 72 will not be drawn from recess 72 into the clearance gap between the lower end and actuating piston 46 since the fuel will migrate to the area of lower pressure which is maintained in drain passage 70. Drain passage 70 is maintained at a lower pressure than the valve cover environment and low pressure portion 52 by connecting drain passage 70 to the fuel supply pump inlet which exists at a mild vacuum or to the fuel tank which is maintained at ambient/atmospheric pressure. In a conventional engine, low pressure portion 52 and the valve cover environment is maintained at a slight pressure due to blow-by gases. Thus, fuel to oil leakage is prevented by the present sealing arrangement 66. Of course, it is possible that lube oil may migrate into the clearance gap and flow into drain passage 70 and thus into the fuel supply. However, the lube oil would simply be burned with the fuel in the normal combustion process without deleterious effects on engine components and engine emissions.

As shown in FIG. 3, the present compression braking system also includes a pressure reduction device indicated at 74 for decreasing the pressure in high pressure portion 50 after a predetermined amount of movement of actuating piston 46 toward the extended position so as to decrease the impact force upon piston stop 64 thereby minimizing the detrimental effect of the impact force on actuator 16. Pressure reduction valve device 74 includes a passage 76 formed in actuator housing 40 in communication with actuating chamber 44 at one end and a low pressure drain at an opposite end. Passage 76 is positioned axially along actuating chamber 44 so as to be blocked by actuating piston 46 when piston 46 is in the retracted position and uncovered or unblocked by actuating piston 46 at an optimum point during movement of piston 46 towards its extended position. Pressure reduction device 74 further includes a pressure reduction valve 78 positioned in passage 76 for controlling the flow of high pressure fuel through passage 76. Preferably, pressure reduction valve 78 is a spring biased check valve which prevents fuel flow into actuating chamber 44. Pressure reduction valve is biased by a spring 80 having a biasing force sufficient to block the flow of high pressure fuel from actuating chamber 44 below a predetermined optimum reduced actuating pressure. Thus, during operation, when brake actuating valve 42 is energized into the open position allowing high pressure fuel into high pressure portion 50 of actuating chamber 44, actuating piston 46 begins moving from the retracted position shown in FIG. 3 downwardly toward an extended position. During the initial movement of actuating piston 46 toward the extended position, piston 46 blocks passage 76 thereby permitting the high pressure of the fuel and the high pressure portion 50 to be maintained at a high pressure level. As the low pressure end of piston 46 approaches piston stop 64, piston 46 uncovers passage 76 exposing pressure reduction valve 78 to the high pressure fuel from high pressure portion 50. The high pressure fuel in high pressure portion 50 initially opens pressure reduction valve 74 overcoming the biasing force of spring 80 permitting high pressure fuel to drain through passage 76 until the pressure of the fuel in high pressure portion 50 decreases to a desired reduced actuating pressure. Spring 80 then maintains this reduced pressure by controlling the flow through passage 76. Thus, the fuel pressure in high pressure portion 50 and the resulting pressure forces acting on actuating piston 46 are reduced during the latter portion of the stroke of actuating piston 46 into the extended position. Consequently, the impact forces of piston 46 against piston stop 64 are substantially decreased. Thus, the pressure reduction device of the present invention maintains high pressure forces on the actuating piston during the initial stroke of piston 46 resulting in rapid piston response while significantly decreasing the pressure prior to the end of the piston stroke to reduce piston impact loads to avoid damage to the actuator and/or avoiding the cost of a more durable actuator assembly.

Figure 4:
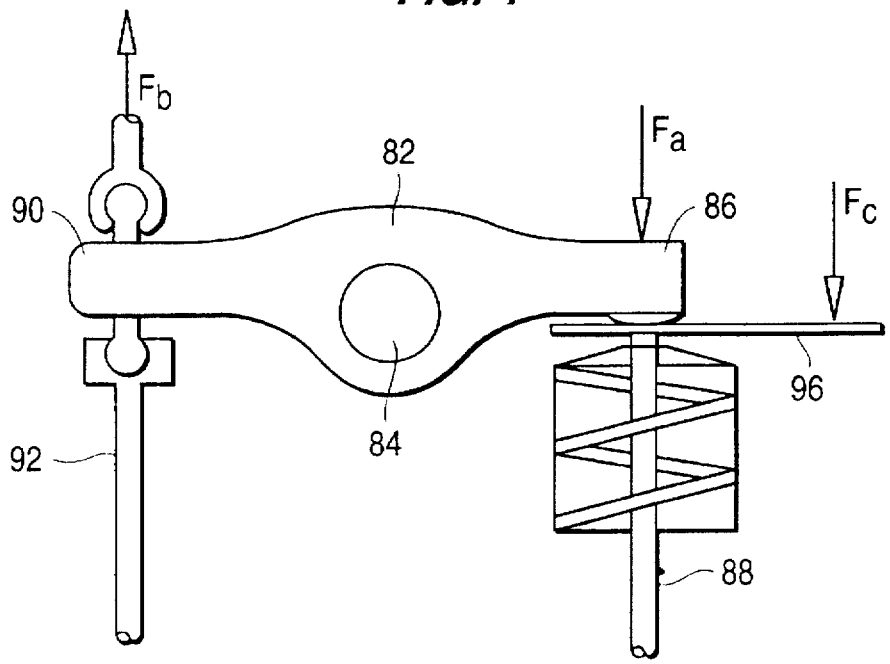
FIG. 4 is a side elevational view of a valve drive train assembly illustrating the various possible locations for applying the actuating force of the actuator of the present invention.
Figure 5:
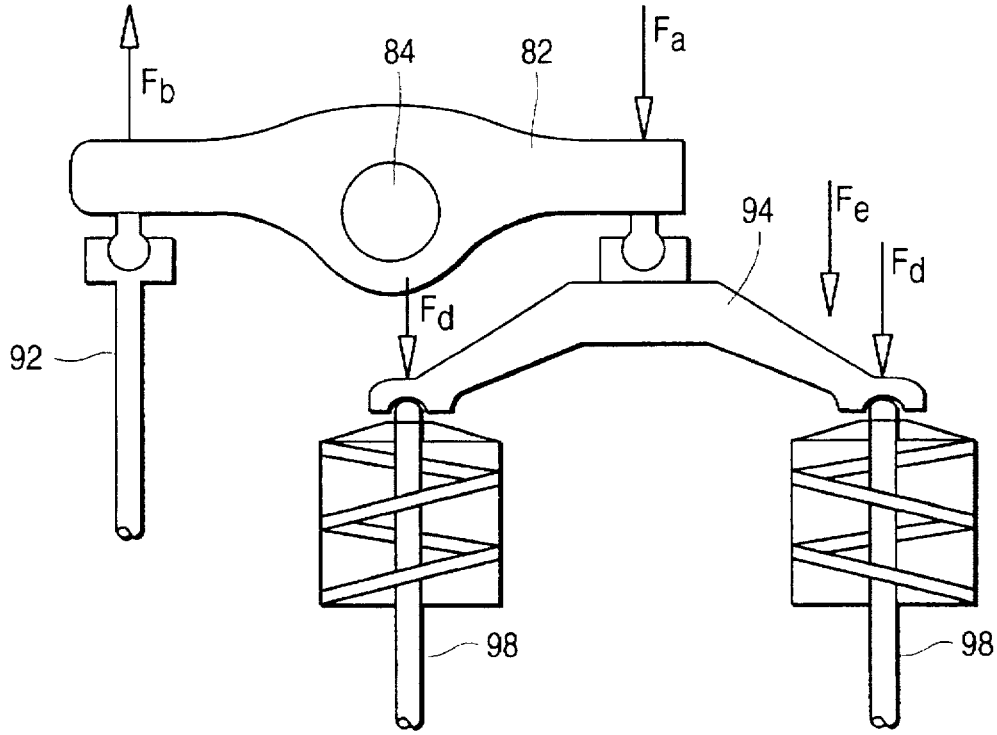
FIG. 5 is a side elevational view of a second embodiment of the exhaust valve drive train assembly illustrating additional possible locations for applying the actuating force of the actuator of the present invention.

FIGS. 4 and 5 illustrate various ways of applying the braking mode actuating force created by actuator 16 to the exhaust valve drive train so as to effectively actuate the exhaust valve or valves. FIG. 4 illustrates an exhaust valve drive train including a rocker lever 82 mounted for pivotal movement on a pivot shaft 84. Rocker lever 82 includes an exhaust valve actuating end 86 for applying an actuating force to an exhaust valve stem 88 for opening the exhaust valve. Rocker lever 82 also includes a power mode force receiving end 90 for receiving an actuating force from, for example, a push rod 92 causing rocker lever 82 to pivot clockwise as shown in FIG. 4 for opening the exhaust valve during the power mode of engine operation. The exhaust valve drive train of FIG. 4 is conventionally used to actuate a single exhaust valve. The exhaust valve drive train shown in FIG. 5, on the other hand, is used to actuate two exhaust valves from a single rocker lever. For example, as shown in FIGS. 4 and 5, actuator 16 may be positioned to apply a force $F_a$ to the top surface of the rocker lever at the exhaust valve actuating end 86 directly above exhaust valve stem 88 or valve crosshead 94. Alternatively, actuator 16 could be positioned to apply a pulling force on the power mode force receiving end 90 as represented by arrows $F_b$. Referring to FIG. 4, in the single exhaust valve scheme, a stem extension 96 may be provided to permit valve actuation without moving rocker lever 82. Stem extension 96 is rigidly connected to the top end of exhaust valve stem 88 and extends outwardly away from actuating end 86 of rocker lever 82. Actuator 16 would then be positioned adjacent stem extension 96 a space distance from rocker lever 82 so as to apply an actuating force $F_c$ to the stem extension 96 and thus the exhaust valve stem 88. Now referring to FIG. 5, a pair of exhaust valves 98 could be simultaneously operated by positioning a respective actuator assembly adjacent the top surface of each end of valve crosshead 94 opposite valves 98 to create a force represented by arrows $F_d$. Alternatively, a single actuator assembly 16 could be arranged adjacent one end of valve crosshead 94 to apply a force $F_e$. The desirability of a particular actuation arrangement would of course depend on the particular application and such factors as the number of exhaust valves actuated, the space provided in the valve cover environment, the actuation forces involved and the strength of the drive train members among other factors.

The use of the present fuel pressure activated engine compression braking system results in several important advantages. First, the present braking system permits operation of the engines exhaust valves during the braking mode independent of the engines mechanical actuating elements, i.e., camshaft and the associated control limitations of such elements. As a result, the present braking system permits the exhaust valves to be controlled during the braking mode according to any desired braking performance curve and thus optimized engine braking performance can be achieved for a particular application or operating condition. Secondly, by using a pressure regulator, the present braking system minimizes the likelihood of leaks in the exhaust valve actuation assembly and/or the cost associated with providing connections capable of sealing fluid under high pressure. Third, since the present system uses relatively few components of simple and compact construction, the system minimizes the height of the engine containing the braking system. Fourth, by using a high pressure fuel source to create the valve actuation force, the present braking system effectively and reliably produces a sufficiently large actuating force necessary to hold the exhaust valve open during the movement of the engine piston toward top dead center. Fifth, the present braking system minimizes pressure losses and dead volume in the fuel injection circuit thereby improving the design and operation of the fuel injection system. Sixth, the sealing arrangement used in the actuator assembly of the present braking system prevents any fuel from leaking into the engine lubricating oil supply thereby avoiding any deleterious effects to the lube oil. Seventh, the pressure reduction valve device used with the actuator assembly of the present invention enables rapid actuator response while advantageously preventing a high impact load upon full opening of the exhaust valve.

INDUSTRIAL APPLICABILITY

The fuel pressure activated engine compression braking system of the present invention may be used in any engine having a high pressure source of accumulated fuel. However, the present braking system finds particular utility in heavy duty engines such as compression ignition engines used on highway vehicles. The braking system, of the present invention, is sufficiently simple to be easily retrofitted in an existing engine without major modification.

We claim:

1. A compression braking system for an internal combustion engine having at least one piston reciprocally mounted within a cylinder for cyclical successive compression and expansion strokes and at least one exhaust valve operable to open against a closing bias to exhaust gas from the cylinder in variable timed relationship to the piston strokes to operate the engine in either a power mode or a braking mode, said braking system comprising:

a high pressure fuel supply means for supplying fuel at high pressure for delivery to the engine including a pump means for pressurizing fuel and a high pressure fuel accumulating means for accumulating and temporarily storing fuel received from said pump means at a predetermined high pressure level said accumulating means supplies fuel at said predetermined high pressure level to a plurality of fuel injectors;

an actuating means for opening said at least one exhaust valve during the braking mode, said actuating means including a braking fuel circuit communicating with said accumulating means and a brake actuating valve positioned along said braking fuel circuit for controlling fuel flow through said braking fuel circuit, wherein fuel flowing through said braking fuel circuit from said accumulating means at a predetermined actuating fuel pressure causes movement of said at least one exhaust valve; and a pressure regulating means positioned downstream of said pump means for maintaining the fuel delivered to said actuating means at a predetermined actuation fluid pressure level, said predetermined actuation fluid pressure level being less than said predetermined high injection pressure level.

2. The braking system of claim 1, wherein said actuating means further includes an actuating chamber positioned in fluidic communication with said braking fuel circuit and an actuating piston operatively connected to said at least one exhaust valve and positioned in said actuating chamber for movement by fuel pressure forces.

3. The braking system of claim 2, wherein said pressure regulating means is positioned along said braking fluid circuit downstream of said accumulating means.

4. The braking system of claim 2, wherein said fuel supply means includes an injection fuel circuit for delivering injection fuel from said pump means to said plurality of injectors for injection into respective cylinders.

5. The braking system of claim 4, wherein said pressure regulating means is positioned along said injection fuel circuit between said pump means and said accumulating means.

6. The braking system of claim 1, further including a rocker lever for actuating said at least one exhaust valve, said rocker lever including a power mode force receiving end and an exhaust valve actuating end.

7. The braking system of claim 6, wherein said actuating means imparts an actuating force on said exhaust valve actuating end of said rocker lever to move said exhaust valve.

8. The braking system of claim 6, wherein said actuating means imparts an actuating force on said power mode force receiving end of said rocker lever to move said exhaust valve.

9. The braking system of claim 6, further including a valve crosshead connecting said rocker lever to said at least one exhaust valve, said actuating means imparting an actuating force on said valve crosshead.

10. The braking system of claim 1, wherein said at least one exhaust valve is opened only during said braking mode.

11. A compression braking system for an internal combustion engine having at least one piston reciprocally mounted within a cylinder for cyclical successive compression and expansion strokes and at least one exhaust valve operable to open against a closing bias to exhaust gas from the cylinder in variable timed relationship to the piston strokes to operate the engine in either a power mode or a braking mode, said braking system comprising:

a high pressure fuel supply means for supplying fuel at a predetermined high pressure for delivery to the engine including a pump means for pressurizing fuel to a predetermined delivery pressure and a fuel circuit for delivering fuel to the engine;

an actuating means for opening said at least one exhaust valve during the braking mode, said actuating means including a braking fuel circuit communicating with said fuel circuit; and a pressure regulator positioned downstream of said pump means for maintaining the fuel delivered to said actuating means at an actuation fluid pressure level, said actuation fluid pressure level being less than said predetermined delivery pressure.

12. The braking system of claim 11, further including a high pressure accumulating means positioned along said fuel circuit for accumulating and temporarily storing fuel received from said pump means at a predetermined high fuel pressure, said braking fuel circuit fluidically connected to said accumulating means.

13. The braking system of claim 12, wherein said actuating means includes a brake actuating valve positioned along said braking fuel circuit for controlling braking fuel flow from said accumulating means.

14. The braking system of claim 13, wherein brake actuating valve is an electronically controlled solenoid operated valve, said actuating means further including an actuating chamber and an actuating piston positioned in said actuating chamber.

15. The braking system of claim 12, wherein said pressure regulating means is positioned along said braking fluid circuit downstream of said accumulating means.

16. The braking system of claim 12, wherein said fuel circuit delivers injection fuel from said pump means to a plurality of injectors for injecting the accumulated fuel into respective engine cylinders, said pressure regulator being positioned along said injection fuel circuit between said pump means and said accumulating means.

17. The braking system of claim 11, further including a rocker lever for actuating said at least one exhaust valve, said rocker lever including a power mode force receiving end and an exhaust valve actuating end.

18. The braking system of claim 15, wherein said actuating means imparts an actuating force on said exhaust valve actuating end of said rocker lever to move said exhaust valve.

19. The braking system of claim 17, wherein said actuating means imparts an actuating force on said power mode force receiving end of said rocker lever to move said exhaust valve.

20. The braking system of claim 17, further including a valve crosshead connecting said rocker lever to said at least one exhaust valve, said actuating means imparting an actuating force on said valve crosshead.

21. The braking system of claim 11, wherein said at least one exhaust valve is opened only during said braking mode.

22. A compression braking system for an internal combustion engine having at least one piston reciprocally mounted within a cylinder for cyclical successive compression and expansion strokes and at least one exhaust valve operable to open against a closing bias to exhaust gas from the cylinder in variable timed relationship to the piston strokes to operate the engine in either a power mode or a braking mode, said braking system comprising:

a high pressure fuel supply means for supplying fuel at high pressure for delivery to the engine including a pump means for pressurizing fuel;

an actuating means for opening said at least one exhaust valve during the braking mode, said actuating means including a braking fuel circuit communicating with said high pressure fuel supply means, a brake actuating valve positioned along said braking fuel circuit for controlling fuel flow through said braking fuel circuit, an actuator housing, an actuating chamber formed in said actuator housing and positioned downstream of said brake actuating valve in fluidic communication with said braking fuel circuit and an actuating piston operatively connected to said at least one exhaust valve and translationally mounted in said actuating chamber for movement by fuel pressure forces, said actuating chamber including a high pressure portion positioned adjacent a first end of said actuating piston and a low pressure portion positioned adjacent a second opposite end of said actuating piston;

a sealing means for preventing leakage of fuel from said high pressure portion to said low pressure portion, said sealing means including a drain passage formed in said actuator housing in communication with said actuating chamber between said high pressure portion and said low pressure portion for directing fuel leaking from said high pressure portion to a drain, wherein said low pressure portion of said actuating chamber is maintained at a low pressure level and said drain passage is maintained at a drain pressure level less than said low pressure level.

23. The braking system of claim 22, wherein said sealing means further includes an annular low pressure seal positioned adjacent said actuating piston and an annular recess formed on said actuating piston in communication with said drain passage.

24. The braking system of claim 22, wherein said sealing means further includes an annular high pressure seal positioned axially along said actuating piston a spaced distance from said low pressure seal.

25. The braking system of claim 22, further including a pressure reduction means for reducing the fuel pressure acting on said actuating piston during movement of said actuating piston, said pressure reduction means including a passage formed in said actuator housing in communication with said actuating chamber and a pressure reduction valve positioned in said passage.

26. A compression braking system for an internal combustion engine having at least one piston reciprocally mounted within a cylinder for cyclical successive compression and expansion strokes and at least one exhaust valve operable to open against a closing bias to exhaust gas from the cylinder in variable timed relationship to the piston strokes to operate the engine in either a power mode or a braking mode, said braking system comprising:

a high pressure fuel supply means for supplying fuel at high pressure for delivery to the engine including a pump means for pressurizing fuel;

an actuating means for opening said at least one exhaust valve during the braking mode, said actuating means including a braking fuel circuit communicating with said high pressure fuel supply means, a brake actuating valve positioned along said braking fuel circuit for controlling fuel flow through said braking fuel circuit, an actuator housing, an actuating chamber formed in said actuator housing and positioned downstream of said brake actuating valve in fluidic communication with said braking fuel circuit and an actuating piston operatively connected to said at least one exhaust valve and positioned in said actuating chamber for movement by fuel pressure forces; and a pressure reduction means for reducing the fuel pressure acting on said actuating piston during movement of said actuating piston, said pressure reduction means including a passage formed in said actuator housing in communication with said actuating chamber and a pressure reduction valve positioned in said passage.

27. The braking system of claim 26, wherein said pressure reduction valve is check valve biased to block fuel flow from said actuating chamber.

* * * * *